US011540695B2

(12) United States Patent
Büsing et al.

(10) Patent No.: US 11,540,695 B2
(45) Date of Patent: Jan. 3, 2023

(54) DISHWASHER HAVING AN IMPROVED STRUCTURE TO IMPROVE DRYING PERFORMANCE

(71) Applicant: Samsung Electronics Co., Ltd., Suwon-si (KR)

(72) Inventors: Johannes Büsing, Suwon-si (KR); Seung Wan Yoo, Suwon-si (KR); Ji Sun Yang, Suwon-si (KR); Sung Soo Han, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 9 days.

(21) Appl. No.: 17/044,252

(22) PCT Filed: Apr. 11, 2019

(86) PCT No.: PCT/KR2019/004365
§ 371 (c)(1),
(2) Date: Sep. 30, 2020

(87) PCT Pub. No.: WO2019/199081
PCT Pub. Date: Oct. 17, 2019

(65) Prior Publication Data

US 2021/0015338 A1 Jan. 21, 2021

(30) Foreign Application Priority Data

Apr. 12, 2018 (KR) ..... 10-2018-0042592

(51) Int. Cl.
*A47L 15/48* (2006.01)

(52) U.S. Cl.
CPC ..... *A47L 15/488* (2013.01); *A47L 15/486* (2013.01)

(58) Field of Classification Search
CPC ..... A47L 15/486; A47L 15/488
See application file for complete search history.

(56) References Cited

U.S. PATENT DOCUMENTS

2009/0095330 A1* 4/2009 Iwanaga ..... A47L 15/488 134/95.2

FOREIGN PATENT DOCUMENTS

| | | | | |
|---|---|---|---|---|
| CN | 107303168 A | | 10/2017 | |
| JP | 2000180060 A | * | 6/2000 | ..... A47L 15/46 |
| JP | 2003-180599 A | | 7/2003 | |
| JP | 2008253544 A | * | 10/2008 | |

(Continued)

OTHER PUBLICATIONS

International Search Report and Written Opinion of the International Searching Authority in connection with International Application No. PCT/KR2019/004365 dated Aug. 2, 2019, 10 pages.

(Continued)

*Primary Examiner* — Joseph L. Perrin
*Assistant Examiner* — Irina Graf

(57) ABSTRACT

A dishwasher includes a tub forming a washing chamber and a blowing unit that blows air into the tub, where the blowing unit includes a housing having a discharge port, a blowing fan disposed inside the housing, and a valve disposed between the blowing fan and the discharge port to prevent moisture from being introduced into the blowing fan, and the valve is rotated from a closed position to an open position by blowing of the blowing fan and return to the closed position again by an own weight thereof.

14 Claims, 11 Drawing Sheets

(56) References Cited

FOREIGN PATENT DOCUMENTS

| | | | | |
|---|---|---|---|---|
| JP | 4508251 | B2 * | 7/2010 | ..... A47L 15/486 |
| JP | 2012112993 | A | 6/2012 | |
| KR | 10-2012-0112993 | A | 10/2012 | |
| KR | 10-2015-0105770 | A | 9/2015 | |
| KR | 10-2015-0108188 | A | 9/2015 | |

OTHER PUBLICATIONS

Notice of Preliminary Rejection dated May 23, 2022 in connection with Korean Patent Application No. 10-2018-0042592, 7 pages.
Communication pursuant to Article 94(3) EPC dated Jun. 15, 2022 in connection with European Patent Application No. 19 784 244.6, 4 pages.

* cited by examiner

DISHWASHER HAVING AN IMPROVED STRUCTURE TO IMPROVE DRYING PERFORMANCE

CROSS-REFERENCE TO RELATED APPLICATIONS

This application is a 371 National Stage of International Application No. PCT/KR2019/004365, filed Apr. 11, 2019, which claims priority to Korean Patent Application No. 10-2018-0042592, filed Apr. 12, 2018, the disclosures of which are herein incorporated by reference in their entirety.

BACKGROUND

1. Field

The present disclosure relates to a dishwasher, and more particularly, to a dishwasher having an improved structure to improve drying performance.

2. Description of Related Art

In recent years, there is a trend of increasing home appliances provided with a drying function such as dishwashers, washing machines, dryers, and the like. A dishwasher is provided with a drying function for removing washing water remaining on a surface of tableware after washing, and a washing machine or dryer is provided with a drying function for drying wet laundry.

As an example, a dishwasher, which is a household appliance that is hygienically and efficiently washes tableware, performs a function of washing contaminated tableware and drying tableware. A drying process of a dishwasher is a process of removing water remaining on the tableware that has been washed. The drying process consists of increasing a temperature of tableware by increasing a temperature of water injected to the tableware during a final rinsing, promoting the evaporation of water remaining on the tableware, and removing the evaporated water vapor.

As a method of removing water vapor inside a tub according to the type of dishwasher, there are a method of performing drying through an adsorbent or the like by circulating air inside the tub to a drying unit by a fan in a case where the drying unit is provided, a method of performing drying by opening a door of the dishwasher and circulating air in the tub without a drying unit, and the like.

SUMMARY

The present disclosure is directed to providing a dishwasher having a structure in which a blowing unit to blow air into a tub during a drying process of the dishwasher may be simply assembled.

One aspect of the present disclosure provides a dishwasher including a tub forming a washing chamber, and a blowing unit configured to blow air into the tub, wherein the blowing unit includes a housing having a discharge port and an inner space, a blowing fan disposed inside the housing, and a valve configured to be rotated from a closed position to an open position by blowing of the blowing fan and to return to the closed position from the open position by an own weight thereof, and wherein the housing comprises a flow passage formed between the blowing fan and the discharge port and in which the valve is disposed, and a rotation region in which at least a portion of the valve is rotatably provided.

The valve may include a rotation shaft, an opening/closing part configured to be rotated in the flow passage about the rotation shaft to open and close the blowing fan through the discharge port, and a weight part positioned on the opposite side of the opening/closing part about the rotation shaft and disposed in the rotation region.

The valve may be configured such that a center of gravity thereof is positioned in the weight part about the rotation shaft.

The valve may be configured such that the center of gravity of the valve is not positioned on the same line as an extension direction of the opening/closing part with respect to the rotation shaft.

The valve may be configured such that the center of gravity of the valve is positioned below the opening/closing part when the valve is disposed in the closed position.

The valve may be configured such that the center of gravity of the valve is positioned above the opening/closing part when the valve is disposed in the open position.

An angle between the open position and the closed position may be 90 degrees.

The blowing unit may further include a stopper to restricting the rotation of the valve, and the stopper may be configured such that one end of the stopper is in contact with the opening/closing part when the valve is disposed in the open position.

The stopper may be configured such that the other end of the stopper is in contact with the weight part when the valve is disposed in the closed position.

The blowing unit may further include a blocking portion disposed between the opening/closing part and the blowing fan to further block moisture from being introduced into the blowing fan.

The housing may include a blowing fan housing in which the blowing fan is disposed and a flow passage housing in which the flow passage is disposed, and wind generated by the blowing fan may flow to the discharge port through the flow passage.

The flow passage housing may include a first region in which the flow passage is disposed, and a second region provided on the opposite side to the flow passage about the rotation shaft and in which the rotation region is disposed.

The opening/closing part may be provided so as not to be in contact with the first region.

The flow passage housing may include a first flow passage housing and a second flow passage housing coupled in a rotation shaft direction, and the rotation shaft may be supported by one of the first flow passage housing and the second flow passage housing.

Another aspect of the present disclosure provides a dishwasher including a tub forming a washing chamber, and a blowing unit configured to blow air into the tub, wherein the blowing unit includes a blowing fan, a housing including a discharge port disposed to face the blowing fan and communicating with the tub, and a flow passage formed between the discharge port and the blowing fan, and a valve disposed on the flow passage to be rotated to one side by blowing of the blowing fan when the blowing fan is driven so that the flow passage is opened and to be rotated to the opposite side by a center of gravity of the valve when the driving of the blowing fan is finished so that the flow passage is closed, wherein the valve includes a rotation shaft, an opening/closing part configured to be rotated in the flow passage about the rotation shaft to open and close the blowing fan through the discharge port, and a weight part disposed on the opposite side of the opening/closing part about the rotation shaft and positioned outside the flow passage, and wherein the housing further includes a stopper to restrict rotation of the valve in one direction or in the opposite direction.

The stopper may be configured such that one end of the stopper is in contact with the opening/closing part when the valve is disposed in the open position, and the other end of the stopper is in contact with the weight part when the valve is disposed in the closed position.

The housing may include a blowing fan housing in which the blowing fan is disposed and a flow passage housing in which the flow passage is disposed, and the flow passage housing may include a first region in which the flow passage is formed and the opening/closing part is disposed, and a second region disposed on the opposite side to the flow passage about the rotation shaft and in which the weight part is disposed.

The valve may be configured such that a center of gravity thereof is positioned in the weight part about the rotation shaft and is not positioned on the same line as an extension direction of the opening/closing part with respect to the rotation shaft.

The stopper may restrict rotation of the valve so that the valve is rotated between 0 degrees and 90 degrees.

Another aspect of the present disclosure provides a dishwasher including a tub forming a washing chamber, a door configured to open and close the tub, and a blowing unit configured to blow air into the tub, wherein the blowing unit includes a blowing fan, a discharge port disposed below the blowing fan, a flow passage formed between the discharge port and the blowing fan, and a valve disposed on the flow passage to open and close the flow passage through rotation, wherein the valve includes a rotation shaft, an opening/closing part disposed on the flow passage, and a weight part disposed on the opposite side of the opening/closing part about the rotation shaft, and wherein the opening/closing part opens the flow passage by being pressed downward by blowing of the blowing fan and being rotated about the rotation shaft when the door is opened and the blowing fan is driven, and closes the flow passage by being rotated back to an original position thereof by a center of gravity of the valve positioned in the weight part when the driving of the blowing fan is finished.

A motor for operating a valve of a blowing unit is not included, so that a malfunction of the motor generated due to water can be prevented.

Further, a size of the blowing unit can be reduced because the valve is operated by an own weight thereof without an additional configuration for operating the valve of the blowing unit, so that a size of a dishwasher itself can be reduced or a size of a washing chamber can be increased.

DETAILED DESCRIPTION

Figure 1:
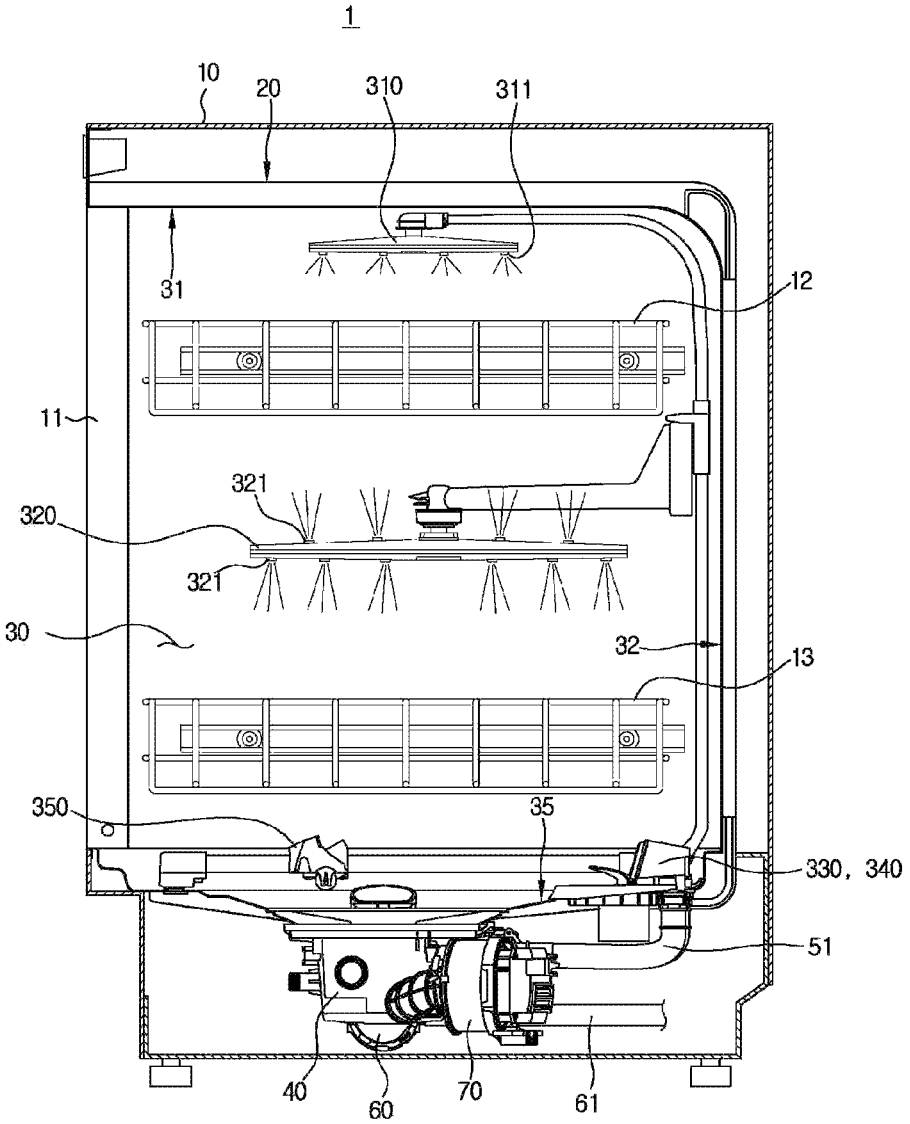
FIG. 1 is a schematic cross-sectional view of a dishwasher according to an embodiment of the present disclosure.

The embodiments described in the present specification and the configurations shown in the drawings are only examples of preferred embodiments of the present disclosure, and various modifications may be made at the time of filing of the present disclosure to replace the embodiments and drawings of the present specification.

Like reference numbers or signs in the various drawings of the application represent parts or components that perform substantially the same functions.

The terms used herein are for the purpose of describing the embodiments and are not intended to restrict and/or to limit the present disclosure. For example, the singular expressions herein may include plural expressions, unless the context clearly dictates otherwise. Also, the terms "comprises" and "has" are intended to indicate that there are features, numbers, steps, operations, elements, parts, or combinations thereof described in the specification, and do not exclude the presence or addition of one or more other features, numbers, steps, operations, elements, parts, or combinations thereof.

Hereinafter, a dishwasher and a control method thereof according to an embodiment of the present disclosure will be described in detail with reference to the accompanying drawings.

Figure 2:
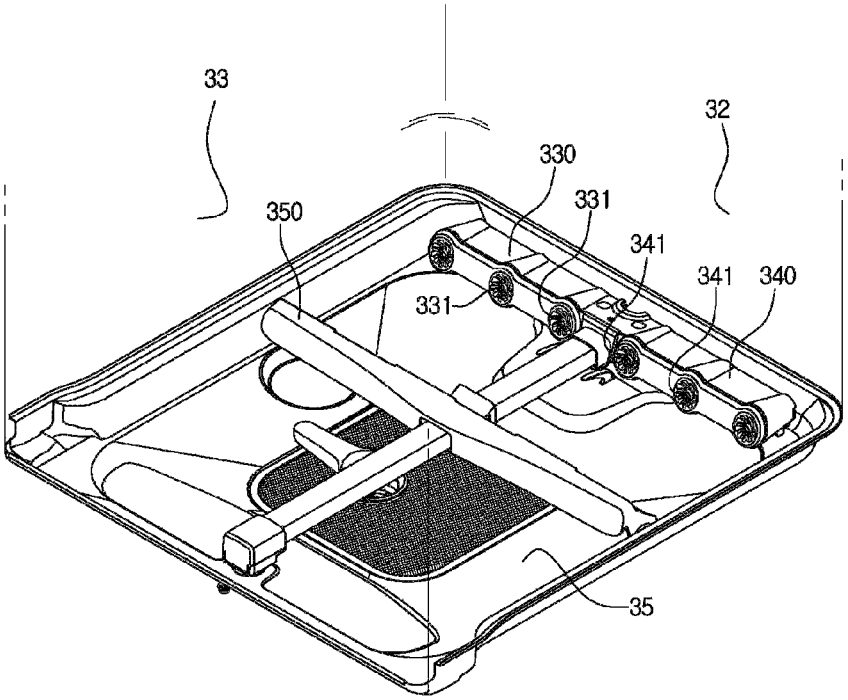
FIG. 2 is a perspective view of a bottom surface of a washing chamber of the dishwasher in FIG. 1.
Figure 3:
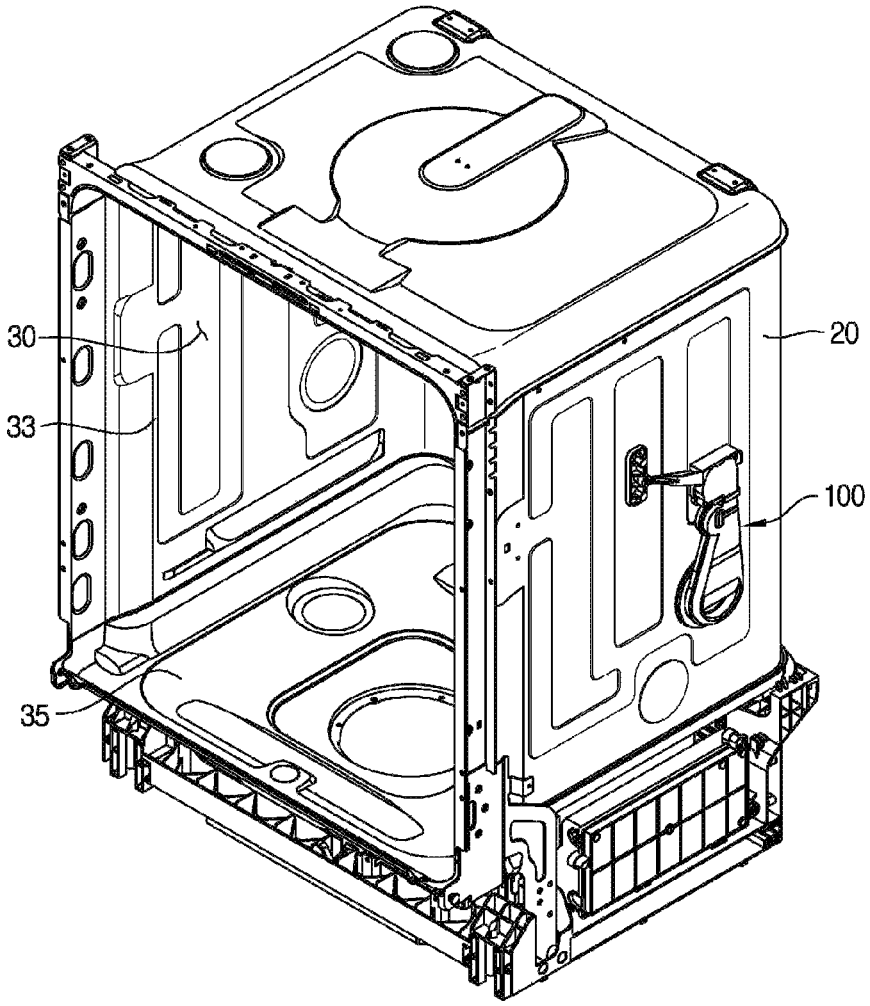
FIG. 3 is a perspective view of a tub of the dishwasher in FIG. 1 viewed from one direction.

FIG. 1 is a schematic cross-sectional view of a dishwasher according to an embodiment of the present disclosure, FIG. 2 is a perspective view of a bottom surface of a washing chamber of the dishwasher in FIG. 1, and FIG. 3 is a perspective view of a tub of the dishwasher in FIG. 1 viewed from one direction.

As illustrated in FIGS. 1 to 3, a dishwasher 1 may include a case forming an outer appearance and a tub 20 disposed inside the case 10 to form a washing chamber 30. The washing chamber 30 may be provided with baskets 12 and 13 configured to receive tableware, injection nozzles 310, 320, 330, and 340 configured to inject washing water, a vane 350 configured to move from a bottom surface 35 of the washing chamber 30 and reflect washing water toward the tableware, and a vane driving device 350 configured to drive the vane 350.

The tub 20 may have a substantially box shape in which an opening is provided in the front to allow tableware to be put in and taken out. The front opening of the tub 20 may be opened and closed by a door 11. The washing chamber 30 formed inside the tub 20 may have a top surface 31, a rear surface 32, a left surface 33, a right surface 34, and the bottom surface 35.

The baskets 12 and 13 may be wire racks made of wires so that washing water may pass through without accumulating. The baskets 12 and 13 may be detachably provided in the washing chamber 30. The baskets 12 and 13 may include the upper basket 12 disposed at an upper portion of the washing chamber 30 and the lower basket 13 disposed at a lower portion of the washing chamber 30.

The injection nozzles 310, 320, 330, and 340 may inject washing water at a high pressure to wash tableware. The injection nozzles 310, 320, 330, and 340 may include the upper rotation nozzle 310 disposed at the upper portion of the washing chamber 30, the intermediate rotation nozzle 320 disposed at a middle portion of the washing chamber 30, and the fixed nozzles 330 and 340 disposed at the lower portion of the washing chamber 30.

The upper rotation nozzle 310 may be disposed above the upper basket 12 to inject washing water downward while rotating by a water pressure. To this end, injection holes 311 may be provided at a lower end of the upper rotation nozzle 310. The upper rotation nozzle 310 may inject washing water directly toward tableware received in the upper basket 12.

The intermediate rotation nozzle 320 may be disposed between the upper basket 12 and the lower basket 13 to inject washing water upward and downward while rotating by a water pressure. To this end, injection holes 321 may be provided at an upper end and a lower end of the intermediate rotation nozzle 320. The intermediate rotation nozzle 320 may inject washing water directly toward tableware received in the upper basket 12 and the lower basket 13.

The fixed nozzles 330 and 340 are provided so as not to move unlike the rotation nozzles 310 and 320 and are fixed to one side of the washing chamber 30. The fixed nozzles 330 and 340 may be disposed substantially adjacent to the rear surface 32 of the washing chamber 30 to inject washing water toward the front of the washing chamber 30. Therefore, washing water injected from the fixed nozzles 330 and 340 may not direct directly to tableware.

The washing water injected from the fixed nozzles 330 and 340 may be reflected toward the tableware by the vane 350. The fixed nozzles 330 and 340 are disposed below the lower basket 13, and the vane 350 may reflect the washing water injected from the fixed nozzles 330 and 340 upward. That is, the washing water injected from the fixed nozzles 330 and 340 may be reflected toward the tableware received in the lower basket 13 by the vane 350.

The fixed nozzles 330 and 340 may each have a plurality of injection holes 331 and 341 arranged in the left and right directions of the washing chamber 30. The plurality of injection holes 331 and 341 may inject washing water toward the front.

The vane 350 may extend long in the left and right directions of the washing chamber 30 to reflect all of the washing water injected from the plurality of injection holes 331 and 341 of the fixed nozzles 330 and 340. That is, one end of the vane 350 in a longitudinal direction may be disposed adjacent to the left surface 33 of the washing chamber 30, and the other end of the vane 350 in the longitudinal direction may be disposed adjacent to the right surface 34 of the washing chamber 30.

The vane 350 may linearly reciprocate along an injecting direction of the washing water injected from the fixed nozzles 330 and 340. That is, the vane 350 may linearly reciprocate along the front and rear directions of the washing chamber 30.

Accordingly, a linear injection structure including the fixed nozzles 330 and 340 and the vane 350 may wash the entire area of the washing chamber 30 without a blind spot. This structure is different from that in which rotation nozzles may inject washing water only within a range of the radius of rotation.

The fixed nozzles 330 and 340 may include the left fixed nozzle 330 disposed on the left side of the washing chamber 30, and the right fixed nozzle 340 disposed on the right side of the washing chamber 30.

The rotation nozzles 310 and 320 and the fixed nozzles 330 and 340 may inject washing water independently of each other. Further, the left fixed nozzle 330 and the right fixed nozzle 340 may also inject washing water independently of each other.

The washing water injected from the left fixed nozzle 330 may be reflected only to a left area of the washing chamber 30 by the vane 350, and the washing water injected from the right fixed nozzle 340 may be reflected only to a right area of the washing chamber 30 by the vane 350.

Therefore, the dishwasher 1 may divide the washing chamber 30 into the left and right sides to wash independently the left and right sides of the washing chamber 30. Unlike the present embodiment, the washing chamber is not necessarily divided into left and right portions, but may be divided into more areas as necessary.

A sump 40 to store washing water, a circulation pump (not shown) to pressurize the washing water in the sump 40 and supply the pressurized washing water to the injection nozzles 310, 320, 330, and 340, and a drain pump 60 to discharge the wastewater stored in the sump 40 after washing to the outside of the case 10 may be disposed at a lower portion of the tub 20. A drain pipe 61 may be connected to the drain pump 60.

The washing water stored in the sump 40 may be heated by a heater 70 to increase the washing efficiency according to the stage of a tableware washing cycle, and may be pressurized by a circulation pump 50 to move to the injection nozzles 310, 320, 330 and 340 through a nozzle water supply pipe 51 and be injected into the washing chamber 30.

However, the dishwasher according to an embodiment of the present disclosure does not include the vane 350 disposed on the bottom surface 35 side of the tub 20, and may be configured in such a manner that the fixed nozzles 330 and 340 disposed on the bottom surface 35 side inject washing water directly toward tableware.

That is, the nozzles 330 and 340 disposed at a lower side among the plurality of injection nozzles 310, 320, 330, and 340 may also rotate like the upper rotation nozzle 310 and the intermediate rotation nozzle 320 and inject washing water in the upward direction from the inside of the tub 20 to directly inject the washing water toward tableware.

After a washing process in which washing water is injected by the injection nozzles 310, 320, 330, and 340 is performed as described above, a drying process proceeds. The drying process includes a process of increasing a temperature of the water injected on tableware during a final rinsing to increase a temperature of the tableware and facilitating evaporation of water remaining on the tableware, and a process of condensing the vaporized water vapor in a drying unit positioned inside or outside the tub or condensing the vaporized water vapor on the wall of the tub to remove the vaporized water vapor.

As a final step of the drying process, the process of removing water vapor remaining in the tableware or tub proceeds, and as methods of removing water vapor according to the type of dishwasher, there are a method of removing water vapor in the tub by an additional drying unit, and a method of forcibly removing water vapor in the tub after opening the door by a controller.

A dishwasher of the type in which the door is opened to remove water vapor does not require an additional drying unit, and thus design of the dishwasher is easy and cost may be reduced.

In the dishwasher 1 according to an embodiment of the present disclosure, a type of removing water vapor remaining in the tub 20 by opening the door 11 described above will be described as an example. However, the present disclosure is not limited thereto, and the dishwasher 1 according to an embodiment of the present disclosure may be a dishwasher of a type in which water vapor remaining in the tub 20 is removed by an additional drying unit in a state where the door 11 is not opened.

In order to facilitate the door 11 of the dishwasher 1 to be opened and the residual water vapor in the tub 20 to flow to the outside, the dishwasher 1 may include a blowing unit 100 configured to blow air into the tub 20 to flow the air inside the tub 20 to the outside.

The blowing unit 100 may guide air inside the tub 20 so that the air inside the tub 20 may flow to the outside of the door 11 by generating wind inside the tub 20. The blowing unit 100 may be disposed inside or outside the tub 20, and may communicate with the washing chamber 30 formed in the tub 20 when disposed outside the tub 20. In an embodiment of the present disclosure, as an example, the dishwasher 1 having the blowing unit 100 disposed outside the tub 20 will be described.

Hereinafter, the blowing unit 100 of the dishwasher 1 will be described in detail.

Figure 4:
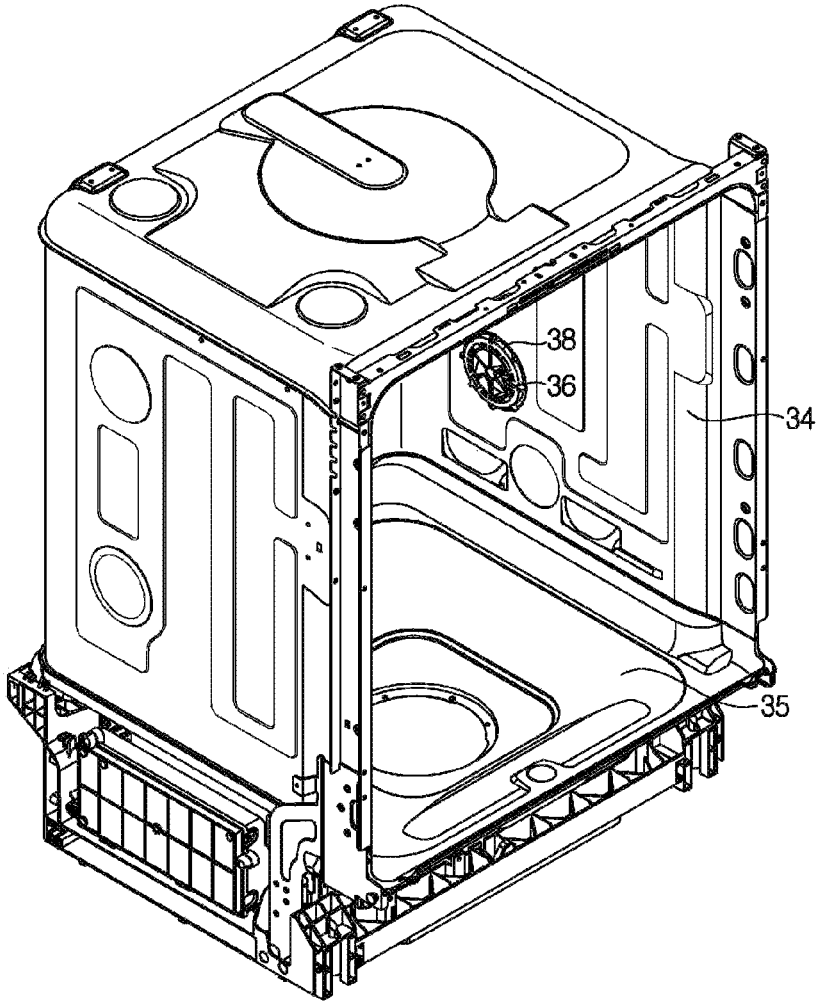
FIG. 4 is a perspective view of the tub of the dishwasher in FIG. 1 viewed from the other direction.
Figure 5:
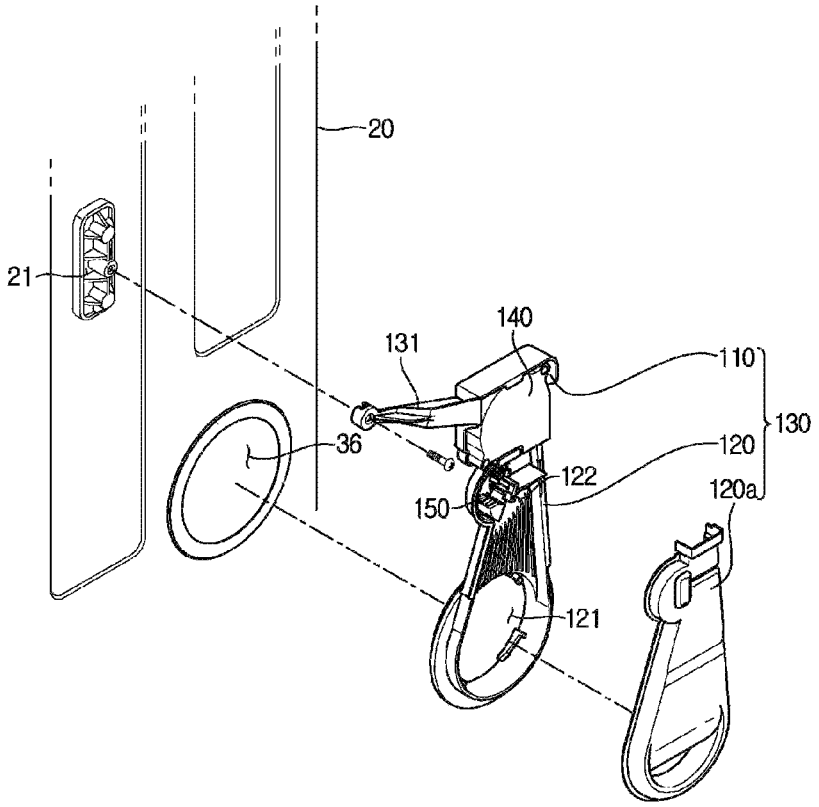
FIG. 5 is an exploded perspective view of a blowing unit of the dishwasher in FIG. 1.
Figure 6:
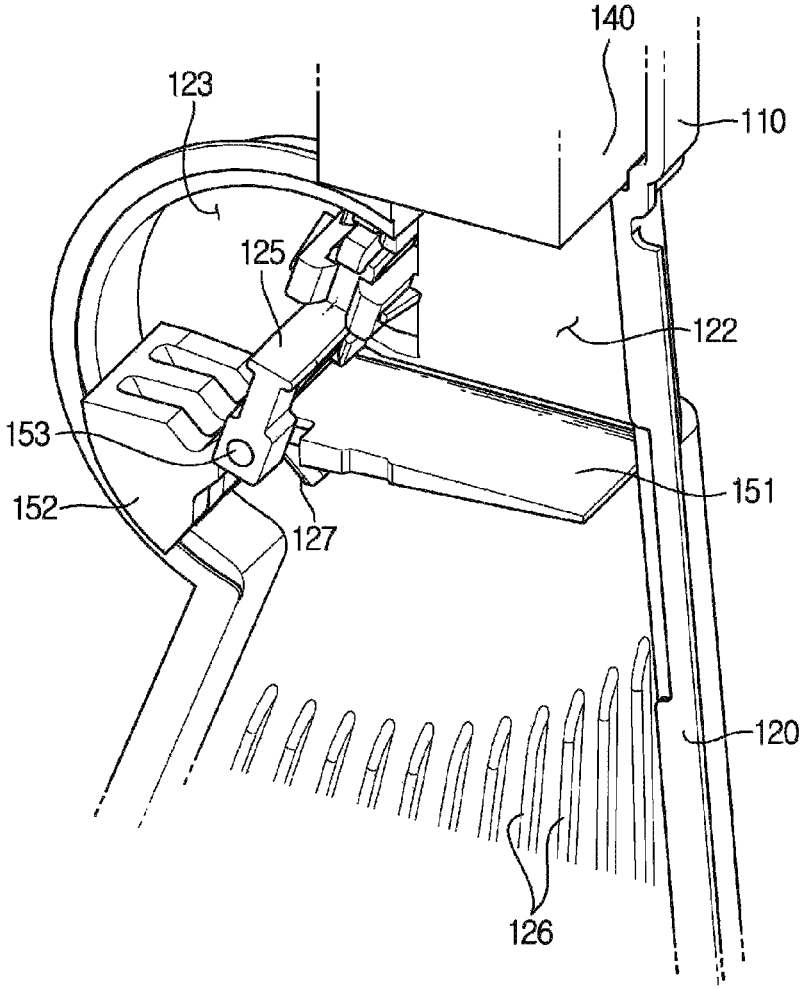
FIG. 6 illustrates a state in which a valve of the blowing unit of the dishwasher in FIG. 1 is in an open position.
Figure 7:
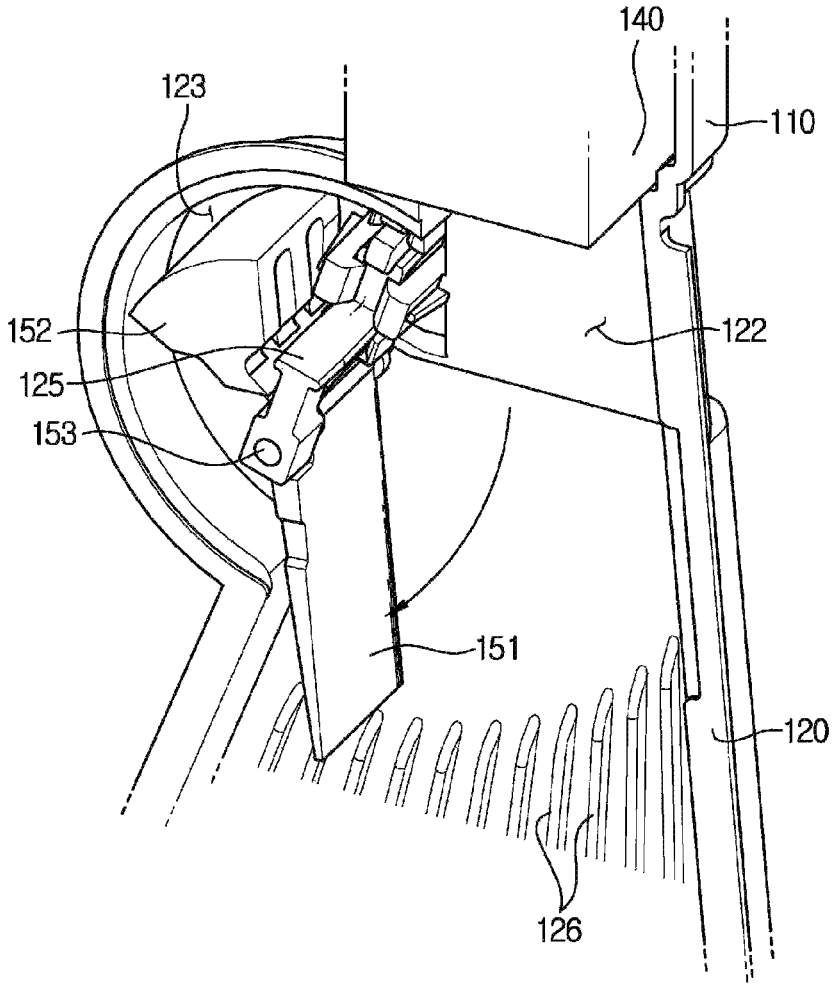
FIG. 7 illustrates a state in which the valve of the blowing unit of the dishwasher in FIG. 1 is in a closed position.

FIG. 4 is a perspective view of the tub of the dishwasher in FIG. 1 viewed from the other direction, FIG. 5 is an exploded perspective view of a blowing unit of the dishwasher in FIG. 1, FIG. 6 illustrates a state in which a valve of the blowing unit of the dishwasher in FIG. 1 is in an open position, and FIG. 7 illustrates a state in which the valve of the blowing unit of the dishwasher in FIG. 1 is in a closed position.

As illustrated in FIGS. 3 and 4, the blowing unit 100 may be disposed outside the tub 20. As described above, the blowing unit 100 is disposed outside the tub 20, and thus may be disposed to communicate with a connection hole 36 formed on the right surface 34.

Accordingly, air blown from the blowing unit 100 flows into the washing chamber 30 inside the tub 20 through the connection hole 36, and air inside the tub 20 may be blown to the outside of the door by the blowing.

A cap 38 may be disposed on the connection hole 36 to prevent foreign substances or the like from being introduced into the blowing unit 100, and an auxiliary fan (not shown) may be provided such that air blown from the blowing unit 100 to the outside of the cap 38 based on the washing chamber 30 is uniformly supplied to the inside of the tub 20.

As illustrated in FIG. 5, the blowing unit 100 may include a housing 130 and a blowing fan 140 disposed inside the housing 130, and the housing 130 may include a discharge port 121 to communicate with the connection hole 36.

As described above, the blowing unit 100 is disposed outside the tub 20, and the housing 130 may include a coupling part 131 to couple the outside of the tub 20 and the blowing unit 100. The coupling part 131 may be coupled to a coupling member 21 disposed outside the tub 20 so that the blowing unit 100 may be coupled to the outside of the tub 20.

However, the present invention is not limited thereto, and the blowing unit 100 does not include the additional coupling part 131 and the housing 130 itself may be directly coupled to the outside of the tub 20. In this case, the additional coupling member 21 may not be required.

Also, the coupling part 131 may be disposed on a flow passage housing 120 side rather than a blowing fan housing 110 side, unlike an embodiment of the present disclosure, and a shape thereof may be variously changed.

The housing 130 may include the blowing fan housing 110 in which the blowing fan 140 is disposed, and the flow passage housing 120 extending below the blowing fan housing 110 and in which the discharge port 121 is disposed. The flow passage housing 120 may include the first flow passage housing 120 and a second flow passage housing 120*a*, and may include a flow passage 122 formed therein as the first flow passage housing 120 and the second flow passage housing 120*a* are assembled.

The flow passage 122 is provided to communicate the blowing fan 140 and the discharge port 121 so that air blown from the blowing fan 140 may be guided to the discharge port 121 to be blown into the tub 20.

The blowing fan housing 110 and the flow passage housing 120 may be integrally formed as in an embodiment of the present disclosure, but are not limited thereto and may be formed separately. The first flow passage housing 120 and the second flow passage housing 120*a* may be integrally formed unlike an embodiment of the present disclosure. However, it is appropriate to be integrally formed for assembly of a valve 150 disposed inside the flow passage 122.

Hereinafter, the first flow passage housing 120 and the second flow passage housing 120*a* are not distinguished from each other and will be collectively referred to as the flow passage housing 120.

The valve 150 configured to selectively open and close the flow passage 122 through rotation may be disposed on the flow passage 122 that is disposed above the discharge port 121 and connects the blowing fan 140 and the discharge port 121 in the upward and downward directions.

The valve 150 may open the flow passage 122 when the blowing fan 140 is driven so that air generated from the blowing fan 140 flows to the discharge port 121, and may close the flow passage 122 when the driving of the blowing fan 140 is finished so that water vapor remaining in the tub 20 is prevented from being introduced into the blowing fan 140 inversely through the discharge port 121.

In detail, as illustrated in FIGS. 6 and 7, in a normal state in which the blowing fan 140 is not driven (The process in which the blowing fan 140 is driven is only a process of discharging water vapor inside the tub 20 to the outside by opening the door 11 at the final stage of the drying process, and generally the blowing fan 140 is not driven in most of the processes.), the valve 150 may close the flow passage 122 so that the blowing fan 140 and the discharge port 121 do not communicate with each other.

The valve 150 may include an opening/closing part 151 to open and close the flow passage 122, a rotation shaft 153 to rotate the valve 150, and a weight part 152 to rotate the valve 150 by its own weight. The valve 150 may be rotated about the rotation shaft 153. The opening/closing part 151 may be formed on one side of the valve 150 about the rotation shaft 153 and the weight part 152 may be formed on the opposite side.

The opening/closing part 151 may be maintained in a state of closing the flow passage 122 without being rotated downward by the weight part 152 in the normal state. That is, the opening/closing part 151 is disposed on the flow passage 122, and in detail, in the normal state, the opening/ closing part 151 may be disposed in a direction of facing the cross section of the flow passage 122 to block the flow passage 122.

Accordingly, water vapor introduced into the flow passage 122 through the discharge port 121 may not penetrate to the blowing fan 140 disposed above the valve 150 by the opening/closing part 151.

When the blowing fan 140 is driven, the opening/closing part 151 may be rotated downward about the rotation shaft 153 by wind blown from the blowing fan 140. Accordingly, the flow passage 122 is opened and the wind blown from the blowing fan 140 may flow to the discharge port 121 through the flow passage 122.

The opening/closing part 151 may be provided to have a thinner thickness as the opening/closing part 151 extends from the rotation shaft 153 in a radial direction of the rotation shaft 153. That is, the opening/closing part 151 may be provided in a tapered shape toward the outside from the rotation shaft 153.

As described above, the opening/closing part 151 is pressed and rotated by wind generated from the blowing fan 140, and this is to enable the opening/closing part 151 to be easily rotated even when the pressure of the wind generated from the blowing fan 140 is small.

In addition, when the opening/closing part 151 returns to its original position after the driving of the blowing fan 140 is finished, through the above configuration, the opening/closing part 151 may be less affected by gravity when rotated, so that the opening/closing part 151 may be easily returned to its original position.

A plurality of guides 126 for guiding the blown air is provided on the flow passage 122 so that the air in the flow passage 122 may easily move to the discharge port 121.

The weight part 152, which is a portion of the valve 150 having a predetermined weight, may prevent the opening/closing part 151 from being rotated downward in the normal state by its own weight. However, the weight of the weight part 152 may be set such that a force of the blown air pushing the opening/closing part 151 downward when air is blown from the blowing fan 140 is greater than the force of gravity due to the own weight of the weight part 152. Accordingly, when the blowing fan 140 is driven, the opening/closing part 151 is rotated downward by the air blown from the blowing fan 140, and the weight part 152 may be rotated upwardly about the rotation shaft 153 by interlocking with the opening/closing part 151.

As described above, as the opening/closing part 151 is formed in a radially tapered shape with respect to the rotation shaft 153, a set weight value of the weight part 152 may be further reduced.

The flow passage housing 120 may include a rotation region 123 formed on the opposite side of the flow passage 122 about the rotation shaft 153 to allow the weight part 152 to be rotated.

The rotation region 123 is a region other than the flow passage 122 in the flow passage housing 120, and may be defined as a second region when the flow passage 122 is assumed to be a first region.

The rotation region 123 is a region in which the weight part 152 is disposed, and may be a minimum region in which the weight part 152 may be rotated about the rotation shaft 153 when the valve 150 is rotated. Therefore, the rotation region 123 may not limit the rotation of the weight part 152 when the weight part 152 is rotated.

The flow passage housing 120 may include a support part 125 to rotatably support the rotation shaft 153. The support part 125 may include an insertion groove into which the rotation shaft 153 is inserted, so that the rotation shaft 153 may be rotatably supported inside the insertion groove. The support part 125 may be configured to support opposite ends of the rotation shaft 153 so that the valve 150 may be stably rotated inside the flow passage housing 120.

As described above, the flow passage housing 120 may include the first flow passage housing 120 and the second flow passage housing **120*a*, and as such, when the flow passage housing 120 includes a plurality of the housings 120 and 120*a*, the support part 125 may be disposed only in one of the first flow passage housing 120 and the second flow passage housing 120*a***.

This is because the opposite ends of the rotation shaft 153 may be supported in an unbalanced state due to an assembly matter when one end and the other end of the rotation shaft 153 are supported by the different housings 120 and **120*a*, respectively. In the dishwasher 1 according to an embodiment of the present disclosure, the support part 125 may be disposed in the first flow passage housing 120, but is not limited thereto and may be disposed in the second flow passage housing 120*a***.

The support part 125 may be disposed detachably with respect to the flow passage housing 120. That is, a portion of the support part 125 supporting one end of the rotation shaft 153 may be provided to be detachable from the flow passage housing 120. This is for assembly improvement of the valve 150, and the support part 125 is not limited thereto and may be integrally formed with the flow passage housing 120.

Hereinafter, a technical characteristic in which the valve 150 is rotated will be described in detail.

Figure 8A:
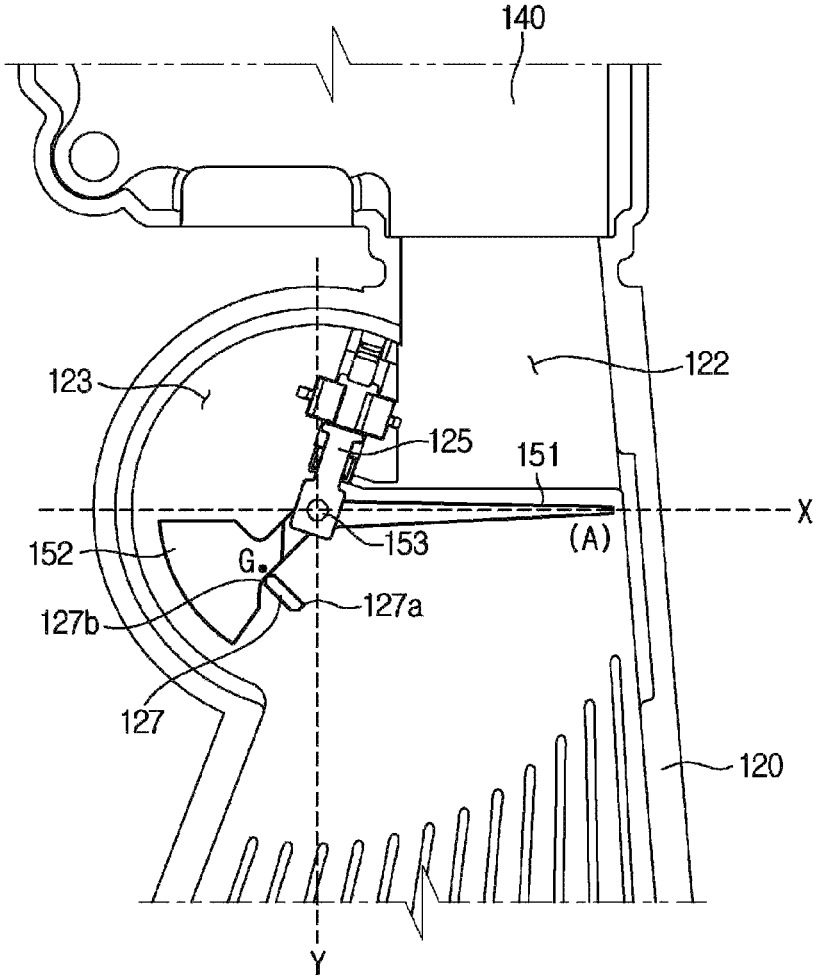
FIG. 8A is a schematic view of the closed position of the valve of the blowing unit of the dishwasher in FIG. 1.
Figure 8B:
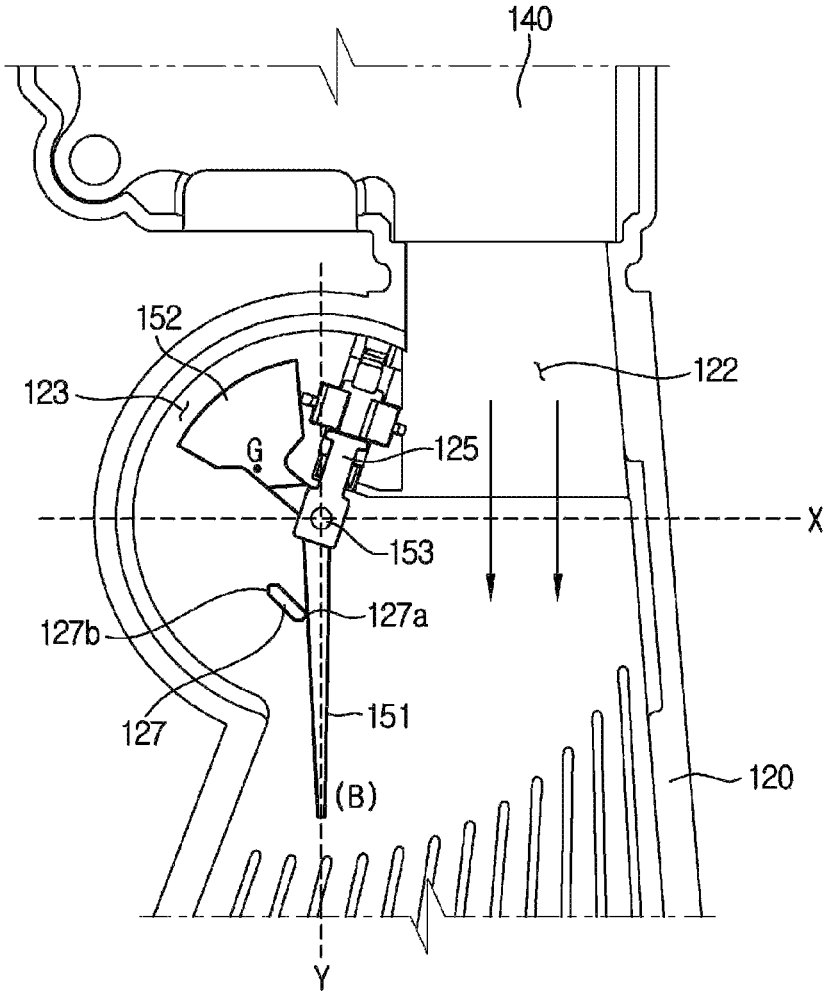
FIG. 8B is a schematic view of the open position of the valve of the blowing unit of the dishwasher in FIG. 1.
Figure 9A:
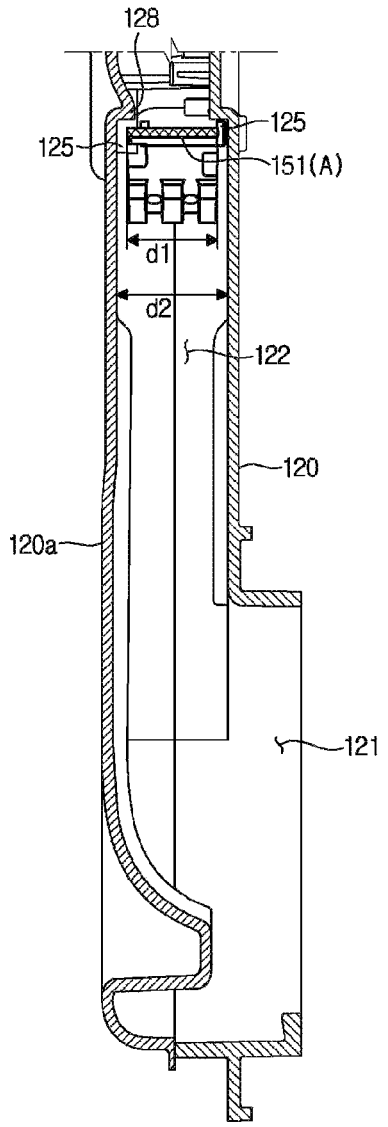
FIG. 9A is a schematic cross-sectional view of the closed position of the valve of the blowing unit of the dishwasher in FIG. 1.
Figure 9B:
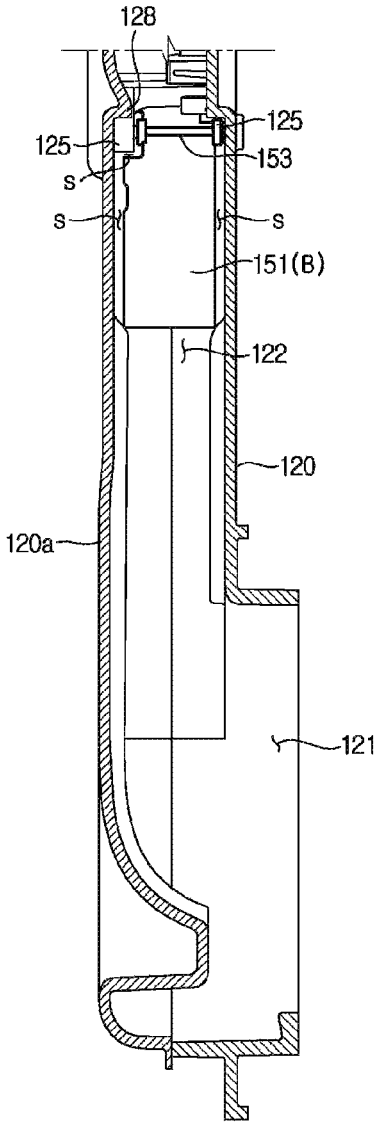
FIG. 9B is a schematic cross-sectional view of the open position of the valve of the blowing unit of the dishwasher in FIG. 1.

FIG. 8A is a schematic view of the closed position of the valve of the blowing unit of the dishwasher in FIG. 1, FIG. 8B is a schematic view of the open position of the valve of the blowing unit of the dishwasher in FIG. 1, FIG. 9A is a schematic cross-sectional view of the closed position of the valve of the blowing unit of the dishwasher in FIG. 1, and FIG. 9B is a schematic cross-sectional view of the open position of the valve of the blowing unit of the dishwasher in FIG. 1.

As illustrated in FIG. 8A, when the blowing fan 140 is not driven, the valve 150 may be provided such that the opening/closing part 151 may be disposed in a direction substantially corresponding to a horizontal direction X about the tub 20. The opening/closing part 151 may block the flow passage 122 by being disposed in the horizontal direction X, thereby preventing water vapor from being introduced into the blowing fan 140. That is, the opening/closing part 151 may be disposed in a closed position A in which the flow passage 122 is closed.

When the opening/closing part 151 is disposed in the closed position A, the opening/closing part 151 is not rotated downward about the rotation shaft 153 by the own weight of the weight part 152 disposed on the opposite side of the opening/closing part 151 about the rotation shaft 153.

A center of gravity G of the valve 150 based on the rotation shaft 153 may be positioned on the weight part 152. As the center of gravity G based on the rotation shaft 153 is positioned on the opposite side of the opening/closing part 151, the opening/closing part 151 does not rotate downward about the rotation shaft 153 as long as an external force is not applied to the valve 150.

The flow passage housing 120 may include a stopper 127 configured to prevent the valve 150 from being rotated arbitrarily when the opening/closing part 151 is disposed in the closed position A. As described above, as the center of gravity G is positioned at the weight part 152, the opening/ closing part 151 is not rotated downward, but as the weight part 152 is rotated downward by the own weight of the weight part 152, the opening/closing part 151 may be rotated upward.

To prevent this, the flow passage housing 120 may include the stopper 127 disposed in contact with the weight part 152 when the opening/closing part 151 is in the closed position A. When the opening/closing part 151 is in the closed position A, the other end 127*b* of the stopper 127 and the weight part 152 are in contact with each other, so that the weight part 152 may be restricted from being rotated downward about the rotation shaft 153. The stopper 127 and one end 127*a* of the stopper 127 will be described in detail below.

As illustrated in FIG. 8B, when the blowing fan 140 is driven, the opening/closing part 151 may be pressed by wind generated in the blowing fan 140 to be rotated downward. The opening/closing part 151 may be rotated from the closed position A to an open position B in which the flow passage 122 is opened by the blowing of the blowing fan 140. The open position B is a position in which the opening/closing part 151 faces in a vertical direction Y corresponding to the vertical direction of the tub 20 about the rotation shaft 153.

As the opening/closing part 151 is disposed in the vertical direction Y, the flow passage 122 is opened and the blowing fan 140 and the discharge port 121 communicate with each other, so that air blown from the blowing fan 140 may be introduced into the tub 20 through the discharge port 121.

As described above, the open position B of the opening/closing part 151 may be defined as a position at which the opening/closing part 151 is disposed to face substantially in the vertical direction Y. Therefore, an arrangement angle between the closed position A and the open position B is substantially 90 degrees, and thus the valve 150 may be rotated substantially 90 degrees about the rotation shaft 153 to selectively open and close the flow passage 122.

The stopper 127 may prevent the opening/closing part 151 from being further rotated about the rotation shaft 153 than from the open position B. That is, the one end 127*a* of the stopper 127 may be disposed to be in contact with one side of the opening/closing part 151 when the opening/closing part 151 is disposed in the open position B.

Accordingly, the rotation of the opening/closing part 151 is restricted by the stopper 127 while the opening/closing part 151 is rotated downward by the blowing of the blowing fan 140, so that the opening/closing part 151 is not further rotated more than the vertical direction Y from the closed position A.

As described above, the stopper 127 may prevent the valve 150 from being further rotated when the valve 150 is in the open position B and the closed position A. The stopper 127 may be disposed between the opening/closing part 151 and the weight part 152 based on the rotation direction of the valve 150. Accordingly, even when the valve 150 is rotated in one direction or the opposite direction with respect to the rotation shaft 153, the opening/closing part 151 or the weight part 152 comes into contact with the stopper 127 during rotation, so that the rotation of the valve 150 may be restricted after being rotated by a certain angle.

Accordingly, a state in which the opening/closing part 151 is disposed in the closed position A or the open position B may be maintained.

The center of gravity G of the valve 150 may be positioned so as not to be disposed on the same line as an extension direction of the opening/closing part 151 based on the rotation shaft 153. That is, when the opening/closing part 151 is disposed in the closed position A, the center of gravity G may be positioned not to be disposed on the horizontal direction X passing through the rotation shaft 153, and when the opening/closing part 151 is disposed in the open position B, the center of gravity G may be positioned not to be disposed on the vertical direction Y passing through the rotation shaft 153.

Assuming that the center of gravity G is positioned on the same line as the extension direction of the opening/closing part 151 based on the rotation shaft 153, when the opening/closing part 151 is disposed in the open position B, the center of gravity G of the valve 150 may be positioned on the vertical direction Y passing through the rotation shaft 153.

When the center of gravity G is positioned on the vertical direction Y passing through the rotation shaft 153, the opening/closing part 151 may not be able to rotate to the closed position A even when the driving of the blowing fan 140 is finished in a state in which the opening/closing part 151 is disposed in the open position B. This is because the center of gravity G is positioned on the rotation shaft, so that a greater gravity according to the weight does not work on either side.

Accordingly, when the valve 150 is disposed in the closed position A, the center of gravity G of the valve 150 may be positioned below the horizontal direction X that is the extension direction of the opening/closing part 151 in the closed position A. Therefore, even when the valve 150 is disposed in the open position B, the center of gravity G of the valve 150 is positioned above the opening/closing part 151 and is not positioned on the vertical direction Y that is the extension direction of the opening/closing part 151 in the open position B.

As described above, the stopper 127 may be disposed in contact with the valve 150 when the valve 150 is disposed in the closed position A and the open position B. When the driving of the blowing fan 140 is stopped, water vapor inside the tub 20 may be introduced into the flow passage housing 120, and in this case, water vapor may be introduced into a portion where the stopper 127 and the valve 150 are in contact with each other, so that moisture may be supplied to the portion where the stopper 127 and the valve 150 are in contact with each other.

The valve 150 is rotated between the closed position A and the open position B, and when rotation starts at each position, the valve 150 may be rotated as contact with the stopper 127 is released. At this time, when moisture is supplied to the portion where the valve 150 and the stopper 127 are in contact, the rotation of the valve 150 may be restricted by the surface tension of water when the contact between the valve 150 and the stopper 127 is released.

That is, when the opening/closing part 151 is rotated from the open position B to the closed position A, rotation starts as the one end 127*a* of the stopper 127 and the opening/closing part 151 are separated by the own weight of the weight part 152 in a state in which the one end 127*a* of the stopper 127 and the opening/closing part 151 are in contact with each other. In a case where a surface tension of water formed between the one end 127*a* of the stopper 127 and the opening/closing part 151 is greater than the force of gravity due to the own weight of the weight part 152 when the one end 127*a* of the stopper 127 and the opening/closing part 151 are separated, the valve 150 may not be able to be rotated from the open position B to the closed position A.

Contrary, in a case where a surface tension of water formed between the other end 127*b* of the stopper 127 and the weight part 152 is greater than a pressing force of the wind blown from the blowing fan 140 when the other end 127*b* of the stopper 127 and the weight part 152 are separated, the valve 150 may not be able to be rotated from the closed position A to the open position B.

To prevent this, the stopper 127 may be provided such that the areas of the one end 127*a* and the other end 127*b* of the stopper 127, which are portions in contact with the valve 150, are minimized.

This is because when the area on the stopper 127 in contact with the valve 150 increases, the surface tension due to water being introduced into the portion where the stopper 127 and the valve 150 in contact with each other may increase. Accordingly, the one end 127*a* and the other end 127*b* of the stopper 127 may be formed in a shape having the shortest side among shapes of the stopper 127.

With this principle, the opening/closing part 151 may be provided on the flow passage 122 so as not to be in contact with the flow passage housing 120. In a case where moisture is supplied when a section in which the opening/closing part 151 comes into contact with at least one side of the flow passage housing 120 occurs while the opening/closing part 151 is rotating, as described above, the rotation of the valve 150 may be restricted by the surface tension.

Also, when a section in which the opening/closing part 151 comes into in contact with at least one side of the flow passage housing 120 on the flow passage 122 occurs, the rotation of the valve 150 may be restricted by a frictional force between the flow passage housing 120 and the opening/closing part.

Accordingly, as illustrated in FIGS. 9A and 9B, the opening/closing part 151 may be provided such that a width d1 of the opening/closing part 151 is smaller than a width d2 of the flow passage 122. Therefore, the opening/closing part 151 may not be affected by the surface tension even when moisture is introduced, and the restriction of rotation due to an additional frictional force thereof may not occur.

The flow passage housing 120 may include a blocking portion 128 disposed between the opening/closing part 151 and the blowing fan 140 to additionally block the inflow of moisture into the blowing fan 140.

As described above, the width d1 of the opening/closing part 151 is smaller than the width d2 of the flow passage 122, and thus moisture may penetrate into a gap(s) formed by a difference (d2−d1) in the widths so that the moisture may be introduced into the blowing fan 140 side. To prevent this, the blocking portion 128 may be formed between the opening/closing part 151 and the blowing fan 140 to further prevent moisture from penetrating into the blowing fan 140.

The blocking portion 128 may be formed in a step shape protruding from one side of the flow passage housing 120 to the inside thereof to block the gap between the opening/closing part 151 and the flow passage 122.

Even when the opening/closing part 151 is disposed in the closed position A or in the open position B, the opening/closing part 151 may be easily rotated inside the flow passage housing 120 without the restriction of rotation to selectively open and close the flow passage 122 as a predetermined gap(s) is formed between the opening/closing part 151 and the flow passage 122.

While the present disclosure has been particularly described with reference to exemplary embodiments, it should be understood by those of skilled in the art that various changes in form and details may be made without departing from the spirit and scope of the present disclosure.

The invention claimed is:

1. A dishwasher comprising:

a tub forming a washing chamber; and a blowing unit comprising:

a housing having a flow passage, a rotation region separate from the flow passage, and a discharge port;

a blowing fan disposed inside the housing and configured to blow air through the flow passage and into the tub through the discharge port; and a valve comprising:

a rotation shaft, an opening/closing part arranged in the flow passage and rotatably coupled to the rotation shaft configured to be rotated from a closed position to close the flow passage to an open position to open the flow passage by blowing of the blowing fan, and a weight part rotatably coupled to the rotation shaft to rotate by rotating the opening/closing part and positioned in the rotation region on an opposite side of the rotation shaft from the opening/closing part and configured to return the opening/closing part to the closed position from the open position, wherein the blowing unit further comprises a stopper to restrict a rotation of the valve, and wherein the stopper is configured such that an end of the stopper is in contact with the opening/closing part when the valve is disposed in the open position.

2. The dishwasher according to claim 1, wherein the opening/closing part is configured to be rotated in the flow passage about the rotation shaft to open and close the flow passage between the blowing fan and the discharge port.

3. The dishwasher according to claim 1, wherein the valve is configured such that a center of gravity for the valve is positioned at the weight part.

4. The dishwasher according to claim 3, wherein the valve is configured such that the center of gravity of the valve is not aligned with an extension direction of the opening/closing part with respect to the rotation shaft.

5. The dishwasher according to claim 1, wherein the valve is configured such that a center of gravity of the valve is positioned below the opening/closing part when the valve is disposed in the closed position.

6. The dishwasher according to claim 1, wherein the valve is configured such that a center of gravity of the valve is positioned above the opening/closing part when the valve is disposed in the open position.

7. The dishwasher according to claim 1, wherein the stopper is configured such that another end of the stopper is in contact with the weight part when the valve is disposed in the closed position.

8. The dishwasher according to claim 1, wherein the blowing unit further comprises a blocking portion disposed between the opening/closing part and the blowing fan to further block moisture from being introduced into the blowing fan.

9. The dishwasher according to claim 1, wherein:

the housing comprises:

a blowing fan housing in which the blowing fan is disposed, and a flow passage housing in which the flow passage is disposed, and wind generated by the blowing fan flows to the discharge port through the flow passage.

10. The dishwasher according to claim 9, wherein the flow passage housing comprises a first region in which the flow passage is disposed, and a second region provided on an opposite side to the flow passage about the rotation shaft and in which the rotation region is disposed.

11. The dishwasher according to claim 10, wherein the opening/closing part is provided so as not to be in contact with the first region.

12. The dishwasher according to claim 9, wherein:

the flow passage housing comprises a first flow passage housing and a second flow passage housing coupled to the first flow passage housing in a rotation shaft direction, and the rotation shaft is supported by one of the first flow passage housing and the second flow passage housing.

13. The dishwasher according to claim 1, wherein an angle between the open position and the closed position is 90 degrees.

14. The dishwasher according to claim 1, wherein the opening/closing part is disposed in the flow passage to be rotated to a side of the flow passage by blowing of the blowing fan when the blowing fan is driven so that the flow passage is opened, and to be rotated to an opposite side of the flow passage by a center of gravity of the valve when driving of the blowing fan is finished so that the flow passage is closed.

* * * * *